US007903051B2

(12) United States Patent
Lee et al.

(10) Patent No.: US 7,903,051 B2
(45) Date of Patent: Mar. 8, 2011

(54) ELECTRO-LUMINESCENCE DISPLAY DEVICE AND DRIVING METHOD THEREOF

(75) Inventors: Dai Yun Lee, Uiwang-shi (KR); Han Sang Lee, Uiwang-shi (KR); Sang Soo Han, Kwachun-shi (KR)

(73) Assignee: LG Display Co., Ltd., Seoul (KR)

( * ) Notice: Subject to any disclaimer, the term of this patent is extended or adjusted under 35 U.S.C. 154(b) by 1798 days.

(21) Appl. No.: 10/825,357

(22) Filed: Apr. 16, 2004

(65) Prior Publication Data

US 2005/0110718 A1 May 26, 2005

(30) Foreign Application Priority Data

Nov. 25, 2003 (KR) ..... 10-2003-0083944

(51) Int. Cl.
*G09G 3/30* (2006.01)

(52) U.S. Cl. ..... 345/76; 313/484

(58) Field of Classification Search ..... 345/45–48, 345/76–84; 313/484
See application file for complete search history.

(56) References Cited

U.S. PATENT DOCUMENTS

| | | | | |
|---|---|---|---|---|
| 6,690,034 | B2 * | 2/2004 | Fujimoto et al. | 257/72 |
| 6,909,409 | B2 * | 6/2005 | Tanada | 345/51 |
| 6,924,602 | B2 * | 8/2005 | Komiya | 315/169.3 |
| 2001/0050662 | A1 | 12/2001 | Atsushi et al. | |
| 2002/0000576 | A1 * | 1/2002 | Inukai | 257/202 |
| 2004/0189584 | A1 * | 9/2004 | Moon | 345/100 |

FOREIGN PATENT DOCUMENTS

| | | |
|---|---|---|
| CN | 14180043 | 5/2003 |
| JP | 2002-214645 | 7/2002 |
| JP | 2002215093 | 7/2002 |
| JP | 2003050564 | 2/2003 |
| KR | 2001-77572 A | 8/2001 |

* cited by examiner

*Primary Examiner* — Amare Mengistu
*Assistant Examiner* — Vinh Lam
(74) *Attorney, Agent, or Firm* — McKenna Long & Aldridge LLP

(57) ABSTRACT

An electro-luminescence display device and a driving method thereof for assuring a high aperture ratio are disclosed. In the device, a plurality of pixel cells is arranged in a matrix type. A plurality of data electrodes applies video signals to the pixel cells. A plurality of gate lines are connected to the pixel cells positioned adjacently to each other at the upper/lower sides thereof in such a manner to cross the data electrodes.

19 Claims, 7 Drawing Sheets

ELECTRO-LUMINESCENCE DISPLAY DEVICE AND DRIVING METHOD THEREOF

This application claims the benefit of Korean Patent Application No. 2003-83944, filed on Nov. 25, 2003, which is hereby incorporated by reference for all purposes as if fully set forth herein.

BACKGROUND OF THE INVENTION

1. Field of the Invention

This invention relates to an electro-luminescence display (ELD), and more particularly to an electro-luminescence display device with a high aperture ratio and a driving method thereof.

2. Discussion of the Related Art

Recently, various flat panel display devices have been developed with reduced weight and size that are capable of eliminating the disadvantages associated with a cathode ray tube (CRT). Such flat panel display devices include liquid crystal displays (LCD), field emission displays (FED), plasma display panels (PDP) and electro-luminescence (EL) panels.

The EL display in such display devices is a self-emission device in which a phosphorous material is excited using recombination of electrons and holes. The EL display device is generally classified into inorganic EL devices and organic EL devices, depending upon a source material for the light-emitting layer. The EL display has the same advantage as the CRT in that it has a faster response speed than passive-type light-emitting devices requiring a separate light source like the LCD.

FIG. 1 is a cross-sectional view showing a related art organic EL structure for explaining a light-emitting principle of the EL display device.

Referring to FIG. 1, the organic EL device includes an electron injection layer 4, an electron carrier layer 6, a light-emitting layer 8, a hole carrier layer 10 and a hole injection layer 12 that are sequentially disposed between a cathode 2 and an anode 14.

If a voltage is applied between a transparent electrode, that is, the anode 14 and a metal electrode, that is, the cathode 2, then electrons produced from the cathode 2 are moved, via the electron injection layer 4 and the electron carrier layer 6, into the light-emitting layer 8, while holes produced from the anode 14 are moved, via the hole injection layer 12 and the hole carrier layer 10, into the light-emitting layer 10. Thus, the electrons and the holes fed from the electron carrier layer 6 and the hole carrier layer 10, respectively, collide at the light-emitting layer 8 to be recombined to generate a light. This light is emitted, via the transparent electrode (i.e., the anode 14), into the exterior to thereby display a picture.

FIG. 2 shows a related art active matrix type EL display device.

Referring to FIG. 2, the related art active matrix type EL display device includes an EL display panel 16 having pixel (hereinafter referred briefly to as "PE") cells 22 arranged at each intersection between gate electrode lines GL and data electrode lines DL, first and second gate drivers 18 and 19 for driving the gate electrode lines GL, and a data driver 20 for driving the data electrode lines DL. The first gate driver 18 sequentially applies a first gate signal to odd-numbered gate electrode lines GL1, GL3, . . . GLn−1. The second gate driver 19 sequentially applies a second gate signal to even-numbered gate electrode lines GL2, GL4, . . . GLn. Herein, the first and second gate signals are set to have the same width (e.g., 1H), and are applied in such a manner to overlap with each other during a predetermined period.

The data driver 20 applies video signals corresponding to a data, via the data electrode lines DL, to the PE cells 22. In this case, the data driver 20 applies the video signals for each one horizontal line to the data electrode lines DL every one horizontal period when the first and second gate signals are supplied.

The PE cells 22 generate a light corresponding to the video signals (i.e., current signals) applied to the data electrode lines DL to thereby display a picture corresponding to the video signals. To this end, as shown in FIG. 3, each PE cell 22 includes a light-emitting cell driving circuit 30 for driving a light-emitting cell OLED in response to a driving signal supplied from each of the data electrode lines DL and the gate electrode lines GL, and a light-emitting cell OLED connected between the light-emitting cell driving circuit 30 and the ground voltage source GND.

The light-emitting cell driving circuit 30 includes a first driving thin film transistor (TFT) T1 connected between the supply voltage line VDD and the light-emitting cell OELD, a first switching TFT T3 connected between the odd-numbered gate electrode line GLo and the data electrode line DL, a second switching TFT T4 connected between the first switching TFT T3 and the even-numbered gate electrode line GL, a second driving TFT T2 connected between a node positioned between the first and second switching TFTs T3 and T4 and the supply voltage line VDD to form a current mirror circuit with respect to the driving TFT T1, and a storage capacitor Cst connected between a node positioned between the first and second driving TFTs T1 and T2 and the supply voltage line VDD. Herein, the TFT is a p-type electron metal-oxide semiconductor field effect transistor (MOSFET).

A gate terminal of the driving TFT T1 is connected to the gate terminal of the second driving TFT T2; a source terminal thereof is connected to the supply voltage line VDD; and a drain terminal thereof is connected to the light-emitting cell OLED. A source terminal of the second driving TFT T2 is connected to the supply voltage line VDD, and a drain terminal thereof is connected to a drain terminal of the first switching TFT T3 and a source terminal of the second switching TFT T4.

A source terminal of the first switching TFT T3 is connected to the data electrode line DL, and a gate terminal thereof is connected to the odd-numbered gate electrode line GLo. A drain terminal of the second switching TFT T4 is connected to the gate terminals of the first and second driving TFTs T1 and T2 and the storage capacitor Cst. A gate terminal of the second switching TFT T4 is connected to the even-numbered gate electrode line GLe.

Herein, the first and second driving TFTs T1 and T2 are connected to each other in such a manner to form a current mirror. Thus, assuming that the first and second driving TFTs T1 and T2 have the same channel width, a current amount flowing in the first driving TFT T1 is set to be equal to a current flowing in the second driving TFT T2.

An operation procedure of such a light-emitting cell driving circuit 30 will be described in detail with reference to a driving waveform of FIG. 4 below.

First and second gate signals SP1 and SP2 having the same width are applied to the odd-numbered electrode line GLo and the even-numbered electrode line GLe making the same horizontal line, respectively, in such a manner to overlap with each other during a predetermined period. Herein, the second gate signal SP2 is applied prior to the first gate signal SP1.

If the first and second gate signals SP1 and SP2 are supplied, then the first and second switching TFTs T3 and T4 are turned on. As the first and second switching TFTs T3 and T4 are turned on, a video signal from the data electrode line DL is applied, via the first and second switching TFTs T3 and T4, to the gate terminals of the first and second driving TFTs T1 and T2. At this time, the first and second driving TFTs T1 and T2 supplied with the video signal are turned on. Herein, the first driving TFT T1 controls a current flowing from the source terminal thereof (i.e., VDD) into the drain terminal thereof in response to the video signal applied to the gate terminal thereof to apply it to the light-emitting cell OLED, thereby allowing the light-emitting cell OLED to emit an amount of light corresponding to the video signal.

At the same time, the second driving TFT T2 applies a current id fed from the supply voltage line VDD, via the first switching TFT T3, to the data electrode line DL. Herein, since the first and second driving TFTs T1 and T2 form a current mirror circuit, the same current flows in the first and second driving TFTs T1 and T2. Meanwhile, the storage capacitor Cst stores a voltage from the supply voltage line VDD in such a manner to correspond to an amount of the current id flowing into the second driving TFT T2. Further, the storage capacitor Cst turns on the first driving TFT T1 using a voltage stored therein when the first and second gate signals SP1 and SP2 are inverted into OFF signals (e.g., ground potentials) to turn off the first and second switching TFTs T3 and T4, thereby applying a current corresponding to the video signal to the light-emitting cell OEL. On the other hand, since the second gate signal SP2 is inverted into an OFF signal earlier than SP1, that is, the second switching TFT T4 is turned off prior to the first switching TFT T3 in the prior art, it is possible to prevent a voltage charged in the storage capacitor Cst from being discharged into the exterior.

In practice, the conventional EL display device sequentially applies the first and second gate signals SP1 and SP2 to the odd-numbered and even-numbered gate electrode lines GLo and GLe, respectively, and applies video signals to the data electrode lines DL, thereby displaying a desired picture. However, such a conventional EL display device has a problem in that, since driving a single of light-emitting cell OELD requires two gate electrode lines at a single of horizontal line and four TFTs, aperture ratio is low. Moreover, such a conventional EL display device has two gate drivers to drive the odd-numbered gate electrode lines GLo and the even-numbered electrode lines GLe, leading to high manufacturing cost.

SUMMARY OF THE INVENTION

Accordingly, the present invention is directed to an electro-luminescence display device and a driving method thereof that substantially obviates one or more of the problems due to limitations and disadvantages of the related art.

An advantage of the present invention is to provide an electro-luminescence display device with a high aperture ratio and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electro-luminescence display device may, for example, include a plurality of pixels arranged in a matrix type; a plurality of data lines for applying video signals to the pixels; and a plurality of gate lines crossing the data lines, one of the gate lines connected to the pixels positioned adjacently to each other at the upper and lower sides of the gate line.

The electro-luminescence display device further includes a gate driver for applying a gate signal having a turn-on potential during two horizontal periods to the gate lines.

Herein, a gate signal applied to the ith gate line (wherein i is an integer) overlaps a gate signal applied to the (i+1)th gate line during one horizontal period.

In anther aspect of the present invention, an electro-luminescence display device may, for example, include electro-luminescence cells arranged in a matrix type at crossings of gate lines and data lines; a supply voltage line for supplying a driving voltage to the electro-luminescence cells; driving circuits for controlling a current applied from the driving voltage of the supply voltage line to the electro-luminescence cells in response to video signals; and control circuits for applying the video signals to the driving circuits.

In the electro-luminescence display device, each of the driving circuits includes a first driving circuit provided at the ith horizontal line (wherein i is an integer) to apply the current to the electro-luminescence cell positioned at the ith horizontal line, in response to a video signal from the control circuit controlled by the ith gate line, when a gate signal is applied to the (i−1)th gate line; and a second driving circuit provided at the (i+1)th horizontal line to apply the current to the electro-luminescence cell positioned at the (i+1)th horizontal line, in response to a video signal from the control circuit controlled by the ith gate line, when a gate signal is applied to the (i+1)th gate line.

Herein, the control circuit is positioned between the first driving circuit and the second driving circuit.

The second driving circuit provided at the (i−1)th horizontal line is connected to the (i−1)th gate line.

The first driving circuit provided at the (i+2)th horizontal line is connected to the (i+1)th gate line.

The first driving circuits includes a first driving thin film transistor having a source terminal connected to the supply voltage line and a drain terminal connected to the electro-luminescence cell positioned at the ith horizontal line; a second driving thin film transistor having a drain terminal connected to a gate terminal of the first driving thin film transistor, a source terminal connected to the control circuit and a gate terminal connected to the (i−1)th gate line; and a storage capacitor connected between the source terminal and the gate terminal of the first driving thin film transistor.

The second driving circuits includes a first driving thin film transistor having a source terminal connected to the supply voltage line and a drain terminal connected to the electro-luminescence cell positioned at the (i+1)th horizontal line; a second driving thin film transistor having a drain terminal connected to a gate terminal of the first driving thin film transistor, a source terminal connected to the control circuit and a gate terminal connected to the (i+1)th gate line; and a storage capacitor connected between the source terminal and the gate terminal of the first driving thin film transistor.

The control circuit includes a first control thin film transistor having a source terminal connected to the supply voltage line and a drain terminal and a gate terminal connected to the source terminal of the second driving thin film transistor; and a second control thin film transistor having a drain terminal connected to the gate terminal of the first control thin film transistor, a source terminal connected to the data line and a gate terminal connected to the ith gate line.

Herein, any one of the first and second control thin film transistors is provided at the ith horizontal line while the remaining control thin film transistor is provided at the (i+1) the horizontal line.

The electro-luminescence display device further includes a gate driver for applying a gate signal having a turn-on potential during two horizontal periods to the gate lines.

Herein, a gate signal applied to the ith gate line overlaps a gate signal applied to the (i+1)th gate line during one horizontal period.

If a gate signal is applied to the (i−1)th and ith gate lines, then the second driving thin film transistor connected to the (i−1)th gate line and the second control thin film transistor connected to the ith gate line are turned on; and, as the second control thin film transistor is turned on, a video signal from the data line is applied to the first driving thin film transistor and the first control thin film transistor that are positioned at the ith horizontal line.

Herein, the first driving thin film transistor positioned at the ith horizontal line applies the current corresponding to the video signal to the electro-luminescence cell provided at the ith horizontal line.

The first control thin film transistor applies the current corresponding to the video signal from the supply voltage line to the data line.

Herein, a voltage corresponding to the current flowing in the first control thin film transistor is stored in the storage capacitor.

In still another aspect of the present invention, an electro-luminescence display device may, for example, include a plurality of pixels arranged in a matrix type; a plurality of data lines for applying video signals to the pixels; a plurality of gate lines crossing the data lines, one of the gate lines being shared with the pixels positioned adjacently to each other at the upper and lower sides of the gate line; electro-luminescence cells provided for each pixel; a supply voltage line for supplying a driving voltage to the electro-luminescence cells; driving circuits for applying a current corresponding to the video signals to the electro-luminescence cells in response to the video signals; and control circuits connected to the data lines to apply the video signals supplied to the data lines to the driving circuits.

The electro-luminescence display device further includes a gate driver for applying a gate signal having a turn-on potential during two horizontal periods to the gate lines.

Herein, a gate signal applied to the ith gate line (wherein i is an integer) overlaps a gate signal applied to the (i+1)th gate line during one horizontal period.

Each of the driving circuits includes a first driving circuit provided at the ith horizontal line (wherein i is an integer) to apply the current to the electro-luminescence cell positioned at the ith horizontal line, in response to a video signal from the control circuit controlled by the ith gate line, when a gate signal is applied to the (i−1)th gate line; and a second driving circuit provided at the (i+1)th horizontal line to apply the current to the electro-luminescence cell positioned at the (i+1)th horizontal line, in response to a video signal from the control circuit controlled by the ith gate line, when a gate signal is applied to the (i+1)th gate line.

Herein, the control circuit is positioned between the first driving circuit and the second driving circuit.

In yet another aspect of the present invention, a method of driving an electro-luminescence display device may, for example, include applying a gate signal having a turn-on potential during two horizontal periods to gate lines, wherein the gate signal applied to the ith gate line (wherein i is an integer) overlaps the gate signal applied to the (i−1)th gate line during one horizontal period.

In the method, a current corresponding to a video signal is applied to an electro-luminescence cell provided at the ith horizontal line during the one horizontal period in which the gate signal applied to the (i−1)th gate line overlaps with the gate signal applied to the ith gate line.

In another aspect of the present invention, a flat panel display device may, for example, include a plurality of gate lines including N−1th, Nth and N+1th gate lines, wherein N is an integer and greater than 1; a plurality of data lines crossing the gate lines; and first, second and third driving blocks, each block being electrically connected with at least one of the data lines and at least one of the gate lines, wherein each block includes first and second driving circuits, and a control circuit; wherein the N−1 th gate line is electrically connected with the first driving circuit of the second driving block and the second driving circuit of the first driving block, the Nth gate line is electrically connected with the control circuit of the second driving block, and N+1th gate line is electrically connected with the second driving circuit of the second driving block and the first driving circuit of the third driving block.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
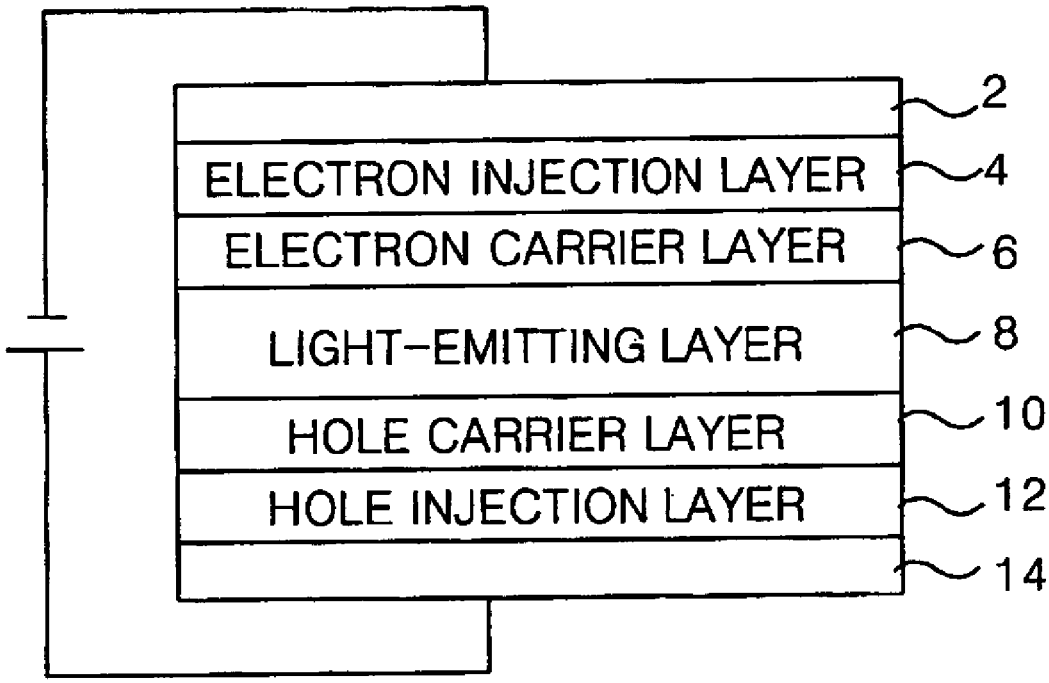
FIG. 1 RELATED ART
FIG. 1 is a schematic cross-sectional view showing a structure of an organic light-emitting cell in a related art electro-luminescence display panel.
Figure 2:
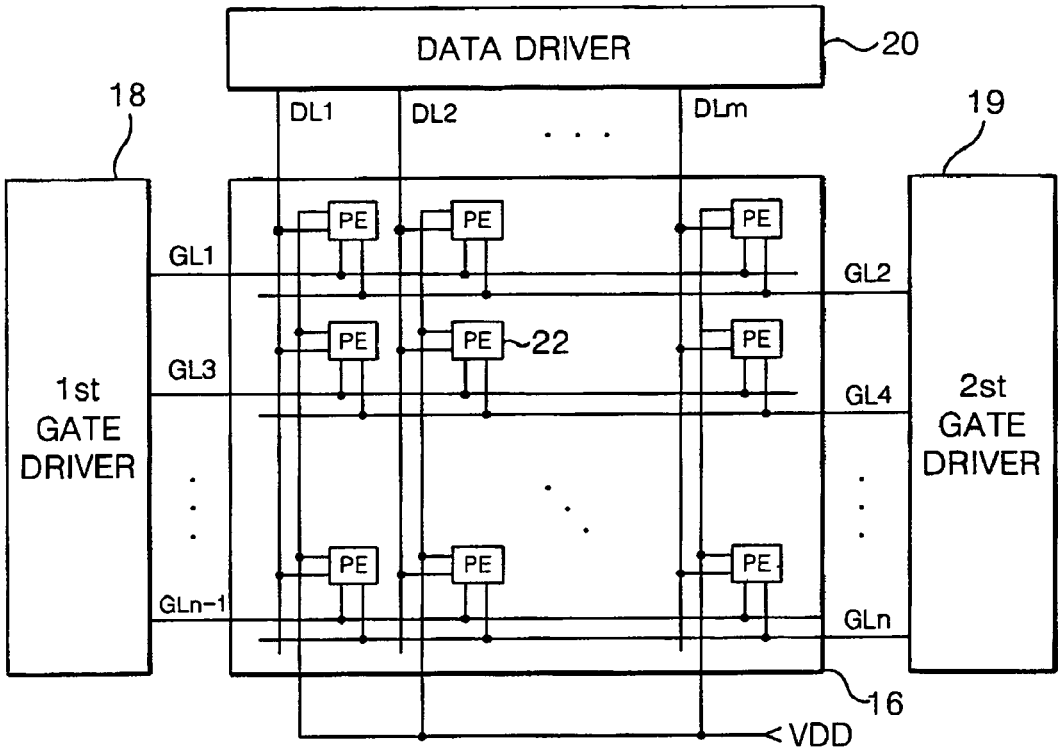
FIG.2 RELATED ART
FIG. 2 is a block diagram showing a configuration of a related art electro-luminescence display panel.
Figure 3:
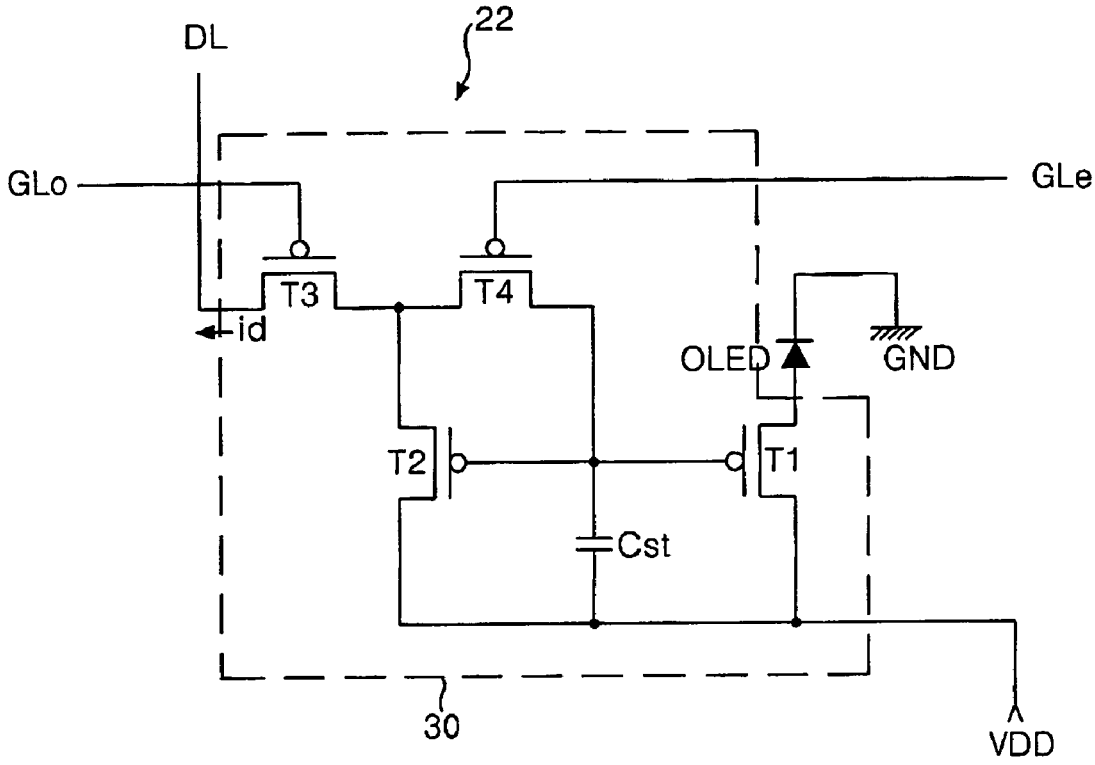
FIG.3 RELATED ART
FIG. 3 is an equivalent circuit diagram of each pixel cell PE shown in FIG. 2.
Figure 4:
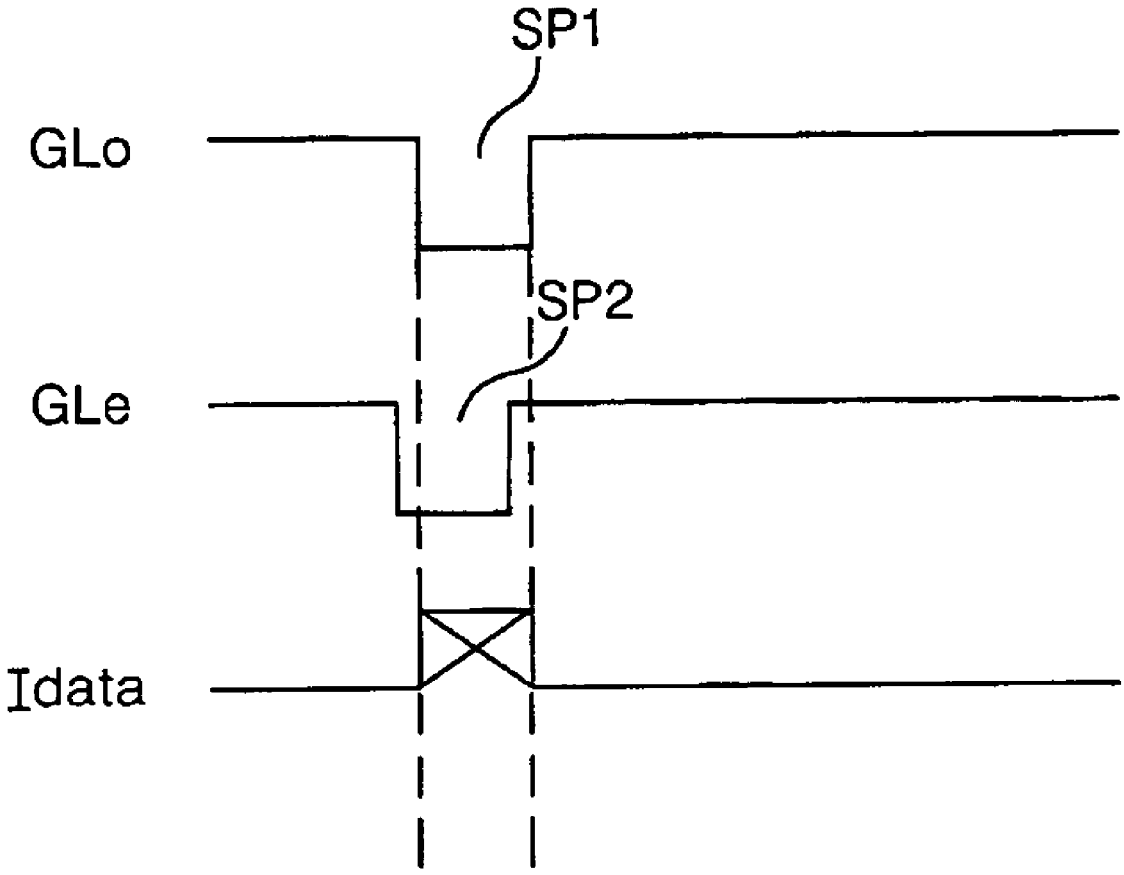
FIG. 4 RELATED ART
FIG. 4 is a waveform diagram of the gate signals applied to the gate lines shown in FIG. 2.
Figure 5:
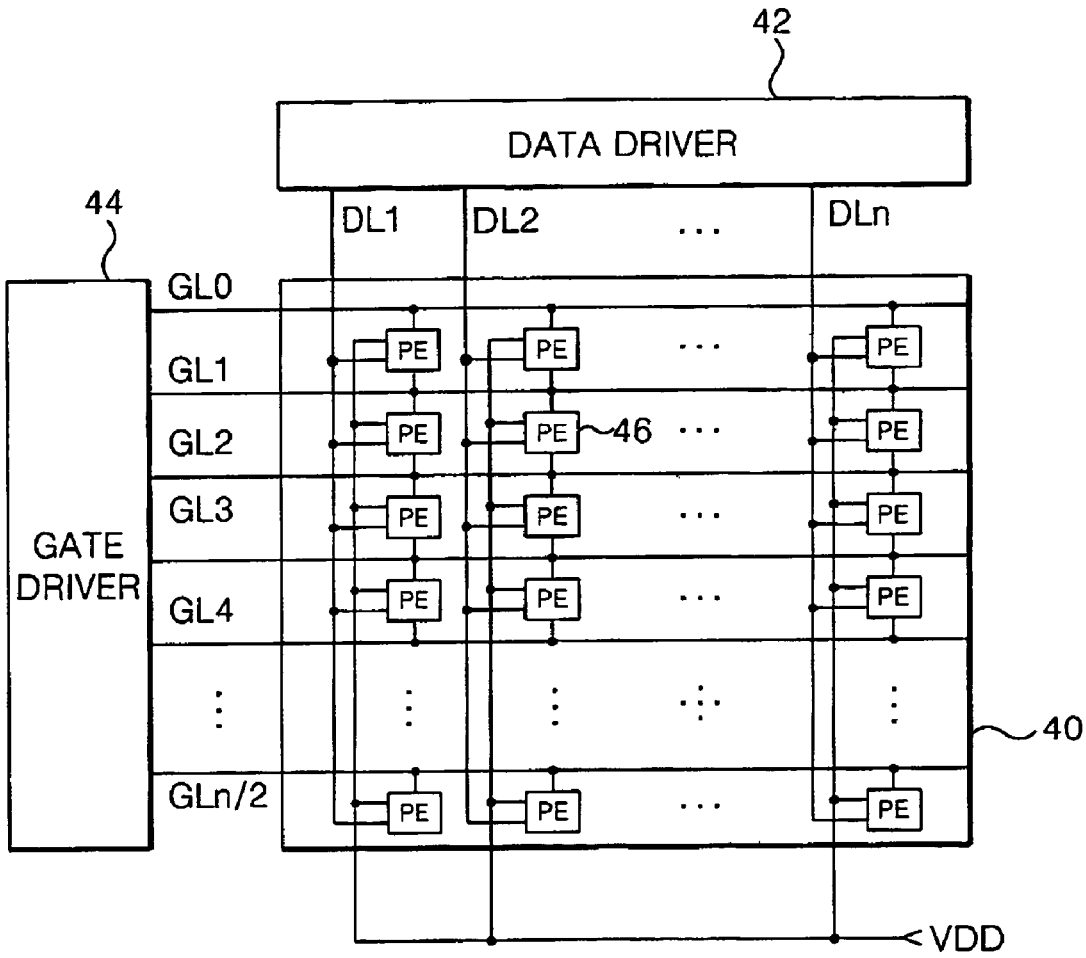
FIG. 5 is a block diagram showing a configuration of an electro-luminescence display device according to an embodiment of the present invention.

FIG. 5 shows an active matrix type electro-luminescence (EL) display device according to an embodiment of the present invention.

Referring to FIG. 5, the EL display device includes an EL display panel 40 having pixel (hereinafter referred briefly to as "PE") cells 46 arranged at each intersection between gate electrode lines GL and data electrode lines DL, a gate driver 44 for driving the gate electrode lines GL, and a data driver 42 for driving the data electrode lines DL.

The gate electrode lines GL are connected to the PE cells 46 positioned at the upper/lower portions thereof. In other words, the ith gate electrode line GLi (wherein i is an integer) is connected to both the PE cells 46 provided at the ith horizontal line and the PE cells 46 provided at the (i+1)th horizontal line. Herein, the ith gate electrode line GLi drives the PE cells 46 provided at the ith and (i+1)th horizontal lines. In other words, the embodiment of the present invention allows a single gate electrode line GL to drive the PE cells 46 positioned adjacently to each other at the upper/lower portions thereof. Thus, this embodiment of the present invention can reduce a number of gate electrode lines GL by half (½) in comparison to the related art, and hence can assure a high aperture ratio. Furthermore, due to the reduced number of gate electrode lines GL, it is possible to drive the EL display device using a single gate driver 44 and to reduce manufacturing cost.

Figure 7:
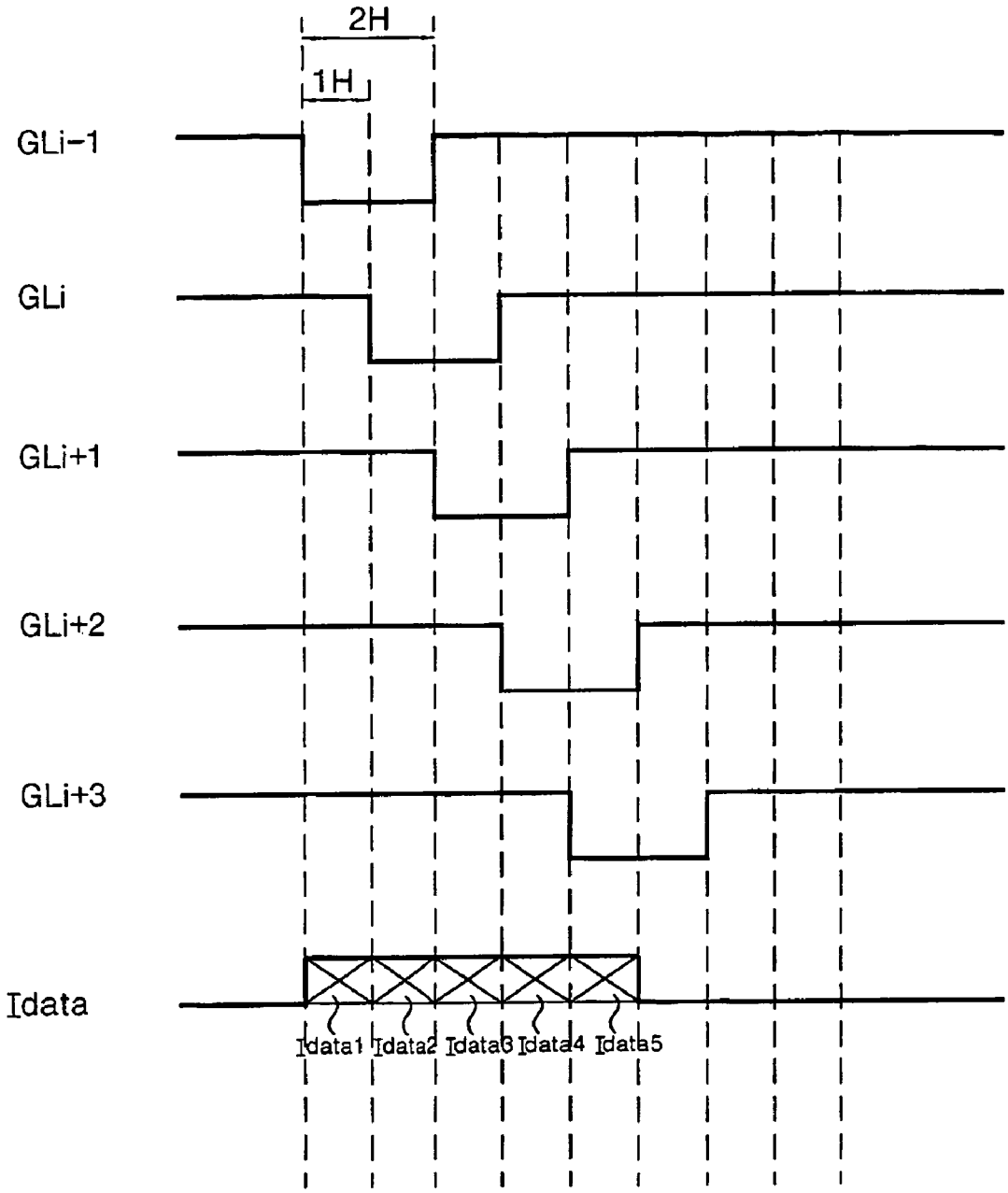
FIG. 7 is a waveform diagram of the gate signals applied to the gate lines shown in FIG. 5.

As shown in FIG. 7, the gate driver sequentially applies a gate signal having a turn-on potential during two horizontal periods (2H) to the gate electrode lines GL. Herein, a gate signal applied to the ith gate electrode line GLi overlaps with a gate signal applied to the (i−1)th gate electrode line GLi−1 during one horizontal period (1H).

The data driver 42 applies video signals corresponding to a data, via the data electrode lines DL, to the PE cells 46. Herein, the data driver 42 applies video signals for each one horizontal line to the data electrode lines DL every one horizontal period (1H).

The PE cells 46 emit a light corresponding to the video signals (i.e., current signals) applied to the data electrode lines DL to thereby display a picture. To this end, the PE cells 46 are configured as shown in FIG. 6.

Figure 6:
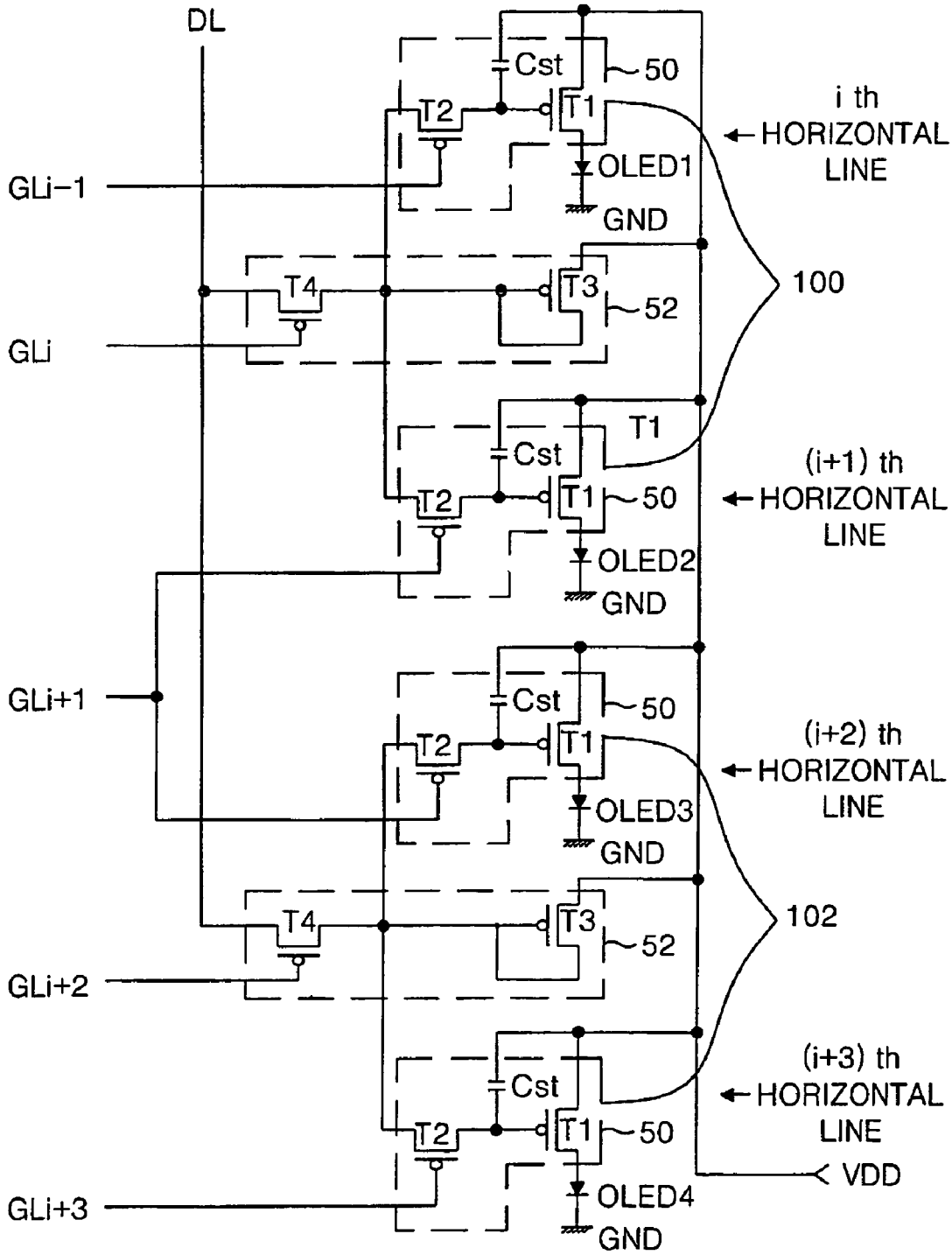
FIG. 6 is an equivalent circuit diagram of each pixel cell PE shown in FIG. 5.

Referring to FIG. 6, the PE cells 46 according to an embodiment of the present invention includes driving circuits 50 for driving the light-emitting cells OLED, and a control circuit 52 for controlling the driving circuits 50 positioned adjacently to each other at the upper/lower portions thereof. Herein, two driving circuits 50 positioned adjacently to each other at the upper/lower portions thereof makes a pair 100 and 102 (hereinafter referred to "driving circuit pair") to be controlled by a single control circuit 52. The control circuit 52 controls two driving circuits 50 under control of a single gate electrode line GL connected thereto.

The driving circuits 50 are configured such that a current can be applied to each light-emitting cell OLED arranged in a matrix type. The control circuit 52 is provided between the driving circuit pairs 100 and 102 to thereby control the driving circuits 50 positioned adjacently to each other at the upper/lower portions thereof. Herein, the control circuit 52 is provided for each driving circuit pair 100 and 102, so that the number of control circuits 52 included in one vertical line is set to be a half of the number of driving circuits 50.

On the other hand, the driving circuits 50 positioned adjacently to each other at the upper/lower portions thereof and not provided with the control circuit 52 therebetween are connected to the same gate electrode line. For instance, if the driving circuits 50 provided at the ith and (i+1)th horizontal lines make a driving circuit pair 100 and the driving circuits 50 provided at the (i+2)th and (i+3)th horizontal lines make a driving circuit pair 102, the driving circuits 50 positioned at the (i+1)th horizontal line and the (i+2)th horizontal line are connected to the same gate electrode line.

The driving circuit 50 provided for each light-emitting cell OLED has two TFTs T1 and T2. For instance, each driving circuit 50 includes a first driving TFT T1 provided between the light-emitting cell OLED and the supply voltage line VDD, and a second driving TFT T2 provided between the first driving TFT T1 and the gate electrode line GL.

Herein, the gate terminal of the second driving TFT T2 included in the first driving circuit 50 of the driving circuit pair 100, for example, the driving circuit 50 provided at the ith horizontal period, is connected to the (i−1) the gate electrode line GLi−1 (wherein, the (i−1)th gate electrode line GLi−1 is also connected to the second driving TFT T2 of the driving circuit 50 provided at the (i−1)th horizontal line), and the source terminal thereof is connected to the control circuit 52 located adjacently. The gate terminal of the first driving TFT T1 included in the driving circuit 50 provided at the ith horizontal line is connected to the drain terminal of the second driving TFT T2, and the source terminal thereof is connected to the supply voltage line VDD. Further, the drain terminal of the first driving TFT T1 is connected to the light-emitting cell OLED1. The storage capacitor Cst is connected between the source terminal and the gate terminal of the first driving TFT T1.

On the other hand, the gate terminal of the second driving TFT T2 included in the second driving circuit 50 of the driving circuit pair 100, for example, the driving circuit 50 provided at the (i+1)th horizontal period, is connected to the (i+1) the gate electrode line GLi+1 (wherein, the (i+1)th gate electrode line GLi+1 is also connected to the second driving TFT T2 of the driving circuit 50 provided at the (i+2)th horizontal line), and the source terminal thereof is connected to the control circuit 52 located adjacently. The gate terminal of the first driving TFT T1 included in the driving circuit 50 provided at the (i+1)th horizontal line is connected to the drain terminal of the second driving TFT T2, and the source terminal thereof is connected to the supply voltage line VDD. Further, the drain terminal of the first driving TFT T1 is connected to the light-emitting cell OLED. The storage capacitor Cst is connected between the source terminal and the gate terminal of the first driving TFT T1. The first and second driving TFTs T1 and T2 included in the driving circuit pairs 100 and 102 are provided for each light-emitting cell OLED in this manner.

The control circuit 52 provided between the driving circuit pair 100, for example, the control circuit 52 positioned between the ith and (i+1)th horizontal lines includes a first control TFT T3 and a second control TFT T4. Herein, two TFTs T3 and T4 included in the control circuit 52 are provided in such a manner to be located at different horizontal lines. For instance, the first control TFT T3 is provided to be located at the ith horizontal line, while the second control TFT T4 is provided to be located at the (i+1)th horizontal line. Alternatively, the first control TFT T3 may be provided to be located at the (i+1)th horizontal line, while the second control TFT T4 may be provided to be located at the ith horizontal line.

The source terminal of the first control TFT T3 is connected to the supply voltage line VDD, and the drain terminal and the gate terminal thereof are connected to the second driving TFT T2 included in the driving circuits 50 positioned at the upper/lower portions thereof. The source terminal of the second control TFT T4 is connected to the data line DL; the drain terminal thereof is connected to the drain terminal and the gate terminal of the first control TFT T3; and the gate terminal thereof is connected to the ith gate electrode line GLi.

An operation procedure of the PE cells 46 according to the embodiment of the present invention will be described in detail with reference to a driving waveform of FIG. 7 below.

First, a gate signal is applied to the (i−1)th gate electrode line GLi−1. Then, another gate signal overlapping with the gate signal supplied to the (i−1)th gate electrode line GLi−1 during one horizontal period (1H) is applied to the ith gate electrode line GLi. As a gate signal is applied to the (i−1)th gate electrode line GLi−1, the second driving TFT T2 positioned at the ith horizontal line is turned on. Further, as a gate signal is applied to the ith gate electrode line GLi, the second control TFT T4 connected to the ith gate electrode line GLi is turned on. As the second control TFT T4 and the second driving TFT T2 are turned on, a video signal from the data electrode line DL is applied to the gate terminals of the first control TFT T3 and the first driving TFT T1. At this time, the first control TFT T3 and the first driving TFT T1 supplied with the video signal are turned on.

Herein, the first driving TFT T1 controls a current flowing from the source terminal thereof (i.e., VDD) into the drain terminal thereof in response to the video signal applied to the gate terminal thereof to apply it to the light-emitting cell OLED, thereby allowing the light-emitting cell OLED 1 to emit an amount of light corresponding to the video signal. At the same time, the first control TFT T3 applies a current fed from the supply voltage line VDD, via the second control TFT T4, to the data electrode line DL. Meanwhile, the storage capacitor Cst stores a voltage from the supply voltage line VDD in such a manner to correspond to an amount of the current flowing in the first control TFT T3. Further, the storage capacitor Cst turns on the first driving TFT T1 using a voltage stored therein when the video signal is not applied, thereby applying a current corresponding to the video signal to the light-emitting cell OLED1.

Thereafter, another gate signal is applied to the (i+1)th gate electrode line GLi+1 in such a manner to overlap with the gate signal applied to the ith gate electrode line GLi. As a gate signal is applied to the (i+1)th gate electrode line GLi+1, the second driving TFT T2 positioned at the (i+1)th horizontal line and the second driving TFT T2 positioned at the (i+2)th horizontal line are turned on. As the second driving TFT T2 positioned at the (i+1)th horizontal line is turned on, a video signal from the data electrode line DL is applied, via the second driving TFT T2 positioned at the (i+1)th horizontal line, to the gate terminal of the first driving TFT T1, thereby turning on the first driving TFT T1.

At this time, the first driving TFT T1 positioned at the (i+1)th horizontal line controls a current flowing from the source terminal thereof (i.e., VDD) into the drain terminal thereof in response to the video signal applied to the gate terminal thereof to apply it to the light-emitting cell OLED, thereby allowing the light-emitting cell OLED2 to emit an amount of light corresponding to the video signal. At the same time, the first control TFT T3 applies a current fed from the supply voltage line VDD that becomes different in accordance with a video signal, via the second control TFT T4, to the data electrode line DL. Meanwhile, the storage capacitor Cst stores a voltage from the supply voltage line VDD in such a manner to correspond to an amount of the current flowing in the first control TFT T3. Further, the storage capacitor Cst turns on the first driving TFT T1 using a voltage stored therein when the video signal is not applied, thereby applying a current corresponding to the video signal to the light-emitting cell OLED2.

Meanwhile, although a gate signal applied to the (i+1) the gate electrode line Gli+1 turns on the second driving TFT T2 positioned at the (i+2)th horizontal line, a video signal fails to reach the light-emitting cell OLED3 positioned at the (i+2)th horizontal line, because the second control TFT T4 positioned between the driving circuit pair 102 is turned off. Thus light is not emitted from the light-emitting cell OLED3 positioned at the (i+2)th horizontal line at this time.

Hereinafter, another gate signal is applied to the (i+2)th gate electrode line GLi+2 in such a manner to overlap with the gate signal applied to the (i+1)th gate electrode line Gli+1. As a gate signal is applied to the (i+2)th gate electrode line Gli+2, the second control TFT T4 connected to the (i+2)th gate electrode line Gli+2 is turned on. As the second control TFT T4 is turned on, a video signal from the data electrode line DL turns on the first control TFT T3 connected to the second control TFT T4 and the first driving TFT T1 positioned at the (i+2)th horizontal line.

At this time, the first driving TFT T1 positioned at the (i+2)th horizontal line controls a current flowing from the source terminal thereof (i.e., VDD) into the drain terminal thereof in response to the video signal applied to the gate terminal thereof to apply it to the light-emitting cell OLED3, thereby allowing the light-emitting cell OLED3 to emit an amount of light corresponding to the video signal. At the same time, the first control TFT T3 applies a current fed from the supply voltage line VDD, via the second control TFT T4, to the data electrode line DL. Meanwhile, the storage capacitor Cst stores a voltage from the supply voltage line VDD in such a manner to correspond to an amount of the current flowing in the first control TFT T3. Further, the storage capacitor Cst turns on the first driving TFT T1 using a voltage stored therein when the video signal is not applied, thereby applying a current corresponding to the video signal to the light-emitting cell OLED3. In practice, the present EL display device repeats the above-mentioned procedure, thereby displaying a desired picture.

Such an EL display device provides a single control circuit between the driving circuit pair positioned adjacently to each other at the upper/lower portions thereof and controls the driving circuit positioned at the upper/lower sides, while controlling the control circuit by a single gate electrode line, so that it can reduce a number of gate electrode lines. In other words, since the driving circuit provided at the upper side of the driving circuit pair is connected to the same gate electrode line as the driving circuit provided at the previous horizontal line while the driving circuit provided at the lower side of the driving circuit pair is connected to the same gate electrode line as the driving circuit provided at the next horizontal line, it becomes possible to minimize the number of gate electrode line and thus to improve an aperture ratio. Furthermore, three TFTs (i.e., two at the driving circuit plus one at the control circuit) are provided for each light-emitting cell arranged in a matrix type, it becomes possible to more improve an aperture ratio.

As described above, according to the present invention, the gate electrode lines control the pixel cells positioned at the upper/lower sides, so that it becomes possible to reduce a number of gate lines and thus to improve an aperture ratio. Furthermore, according to the present invention, three TFTs are included for each pixel cell, so that it becomes possible to more improve an aperture ratio in comparison to the prior art. Moreover, according to the present invention, a number of gate electrode lines are reduced, so that it becomes possible to apply a gate signal to all the gate electrode lines using a single gate driver and thus to reduce manufacturing cost.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence display device, comprising:

electro-luminescence cells arranged in a matrix type at crossings of gate lines and data lines;

a supply voltage line that supplies a driving voltage to the electro-luminescence cells;

driving circuits that control a current applied from the driving voltage of the supply voltage line to drive the electro-luminescence cells in response to video signals, wherein the driving circuits include a plurality of first driving thin film transistors driving each pixel of ith horizontal lines (wherein i is an integer) and a plurality of second driving thin film transistors connected to the gate lines GLe (wherein e=i−1, i+1, i+3 . . . ), wherein a gate terminal of each first driving thin film transistor is connected to a drain terminal of the respective second driving thin film transistor; and control circuits that apply the video signals to the driving circuits, are directly connected between the data line and the supply voltage line, and are controlled by the gate lines GLo (wherein o=i, i+2, i+4 . . . ), and wherein each of the control circuits includes a first control thin film transistor having a source terminal connected to the supply voltage line and a second control thin film transistor having a drain terminal connected to a gate terminal of the first control thin film transistor and having a source terminal connected to the data line.

2. The electro-luminescence display device according to claim 1, wherein a first driving circuit is provided at the ith horizontal line (wherein i is an integer) to apply the current to the electro-luminescence cell positioned at the ith horizontal line, in response to a video signal from the control circuit controlled by the ith gate line, when a gate signal is applied to the (i−1)th gate line, and a second driving circuit is provided at the (i+1)th horizontal line to apply the current to the electro-luminescence cell positioned at the (i+1)th horizontal line, in response to a video signal from the control circuit controlled by the ith gate line, when a gate signal is applied to the (i+1)th gate line.

3. The electro-luminescence display device according to claim 2, wherein the (i+1)th gate line is connected to a driving circuit provided at the (i+2)th horizontal line.

4. The electro-luminescence display device according to claim 2, wherein the (i−1)th gate line is connected to a driving circuit provided at the (i−1)th horizontal line.

5. The electro-luminescence display device according to claim 2, wherein the first driving circuits includes:

the first driving thin film transistor having a source terminal connected to the supply voltage line and a drain terminal connected to the electro-luminescence cell positioned at the ith horizontal line;

the second driving thin film transistor having a drain terminal connected to a gate terminal of the first driving thin film transistor, a source terminal connected to the control circuit and a gate terminal connected to the (i−1) th gate line; and a storage capacitor connected between the source terminal and the gate terminal of the first driving thin film transistor.

6. The electro-luminescence display device according to claim 2, wherein the second driving circuits includes:

the first driving thin film transistor having a source terminal connected to the supply voltage line and a drain terminal connected to the electro-luminescence cell positioned at the (i+1)th horizontal line;

the second driving thin film transistor having a drain terminal connected to a gate terminal of the first driving thin film transistor, a source terminal connected to the control circuit and a gate terminal connected to the (i+1) th gate line; and a storage capacitor connected between the source terminal and the gate terminal of the first driving thin film transistor.

7. The electro-luminescence display device according to claim 5 or 6, wherein the control circuit includes:

the first control thin film transistor having a source terminal connected to the supply voltage line and a drain terminal and a gate terminal connected to the source terminal of the second driving thin film transistor; and the second control thin film transistor having a drain terminal connected to the gate terminal of the first control thin film transistor, a source terminal connected to the data line and a gate terminal connected to the ith gate line.

8. The electro-luminescence display device according to claim 7, wherein any one of the first and second control thin film transistors is provided at the ith horizontal line while the remaining control thin film transistor is provided at the (i+1) th horizontal line.

9. The electro-luminescence display device according to claim 7, further comprising:

a gate driver for applying a gate signal having a turn-on potential during two horizontal periods to the gate lines.

10. The electro-luminescence display device according to claim 9, wherein a gate signal applied to the ith gate line overlaps a gate signal applied to the (i+1)th gate line during one horizontal period.

11. The electro-luminescence display device according to claim 9, wherein, if a gate signal is applied to the (i−1)th and ith gate lines, then the second driving thin film transistor connected to the (i−1)th gate line and the second control thin film transistor connected to the ith gate line are turned on; and as the second control thin film transistor is turned on, a video signal from the data line is applied to the first driving thin film transistor and the first control thin film transistor that are positioned at the ith horizontal line.

12. The electro-luminescence display device according to claim 11, wherein the first driving thin film transistor positioned at the ith horizontal line applies the current corresponding to the video signal to the electro-luminescence cell provided at the ith horizontal line.

13. The electro-luminescence display device according to claim 11, wherein the first control thin film transistor applies the current corresponding to the video signal from the supply voltage line to the data line.

14. The electro-luminescence display device according to claim 13, wherein a voltage corresponding to the current flowing in the first control thin film transistor is stored in the storage capacitor.

15. An electro-luminescence display device, comprising:

a plurality of pixels arranged in a matrix type;

a plurality of data lines that applies video signals to the pixels;

a plurality of gate lines crossing the data lines;

a supply voltage line that supplies a driving voltage to the electro-luminescence cells;

driving circuits that applies a current corresponding to the video signals to the electro-luminescence cells in response to the video signals, wherein the driving circuits include a plurality of first driving thin film transistors driving each pixel of ith horizontal lines (wherein i is an integer) and a plurality of second driving thin film transistors connected to the gate lines GLe (wherein e=i−1, i+1, i+3 . . . ), wherein a gate terminal of each first driving thin film transistor is connected to a drain terminal of the respective second driving thin film transistor; and control circuits that apply the video signals to the driving circuits, are directly connected between the data line and the supply voltage line and are controlled by the gate lines GLo (wherein o=i, i+2, i+4 . . . ), and wherein each of the control circuits includes a first control thin film transistor having a source terminal connected to the supply voltage line and a second control thin film transistor having a drain terminal connected to a gate terminal of the first control thin film transistor and having a source terminal connected to the data line.

16. The electro-luminescence display device according to claim 15, further comprising:

a gate driver for applying a gate signal having a turn-on potential during two horizontal periods to the gate lines.

17. The electro-luminescence display device according to claim 16, wherein a gate signal applied to the ith gate line (wherein i is an integer) overlaps a gate signal applied to the (i+1)th gate line during one horizontal period.

18. The electro-luminescence display device according to claim 17, wherein each of the driving circuits includes:

a first driving circuit provided at the ith horizontal line (wherein i is an integer) to apply the current to the electro-luminescence cell positioned at the ith horizontal line, in response to a video signal from the control circuit controlled by the ith gate line, when a gate signal is applied to the (i−1)th gate line; and a second driving circuit provided at the (i+1)th horizontal line to apply the current to the electro-luminescence cell positioned at the (i+1)th horizontal line, in response to a video signal from the control circuit controlled by the ith gate line, when a gate signal is applied to the (i+1)th gate line.

19. The electro-luminescence display device according to claim 18, wherein one of the control circuits is positioned between the first driving circuit and the second driving circuit.

* * * * *